United States Patent [19]

Lazor

[11] 4,149,273

[45] Apr. 17, 1979

[54] FULL LENGTH SPLIT BELL TROUSERS

[76] Inventor: P. F. Lazor, 43610 Ellsworth, Suite 2, Fremont, Calif. 94538

[21] Appl. No.: 812,442

[22] Filed: Jul. 5, 1977

[51] Int. Cl.[2] ..... A41D 1/06

[52] U.S. Cl. ..... 2/227; 2/DIG. 1

[58] Field of Search ..... 2/227, 232, 232 A, DIG. 1, 2/79, 80; D2/28, 29, 30, 31, 32, 33, 34, 35

[56] References Cited

U.S. PATENT DOCUMENTS

| | | | |
|---|---|---|---|
| 1,153,909 | 9/1915 | Hanes | 2/227 X |
| 2,079,980 | 5/1937 | Anders | 2/227 X |
| 3,372,402 | 3/1968 | Kaufmann | 2/232 |

*Primary Examiner*—H. Hampton Hunter

*Attorney, Agent, or Firm*—William R. Piper

[57] ABSTRACT

A full length split bell pair of trousers in which the front portion of each trouser leg from approximately the knee area to the leg bottom has a cut-away portion to provide a visual entrance to the wearing apparel on both legs, such as boots, socks or even the bare leg which would otherwise be hidden from view. In addition, such a construction provides ventilation to the legs of the wearer. With this arrangement, a greater and easier flexing of the knees is made possible because of a less confinement of the cloth forming the leg portions and the less weight resulting from the cut-out leg portions. Novel construction is used to cause the side edges of the cut-out portions to maintain substantially vertical lines so that the two leg portions will retain their tubular shapes throughout their lengths.

2 Claims, 6 Drawing Figures

FIG. 1.
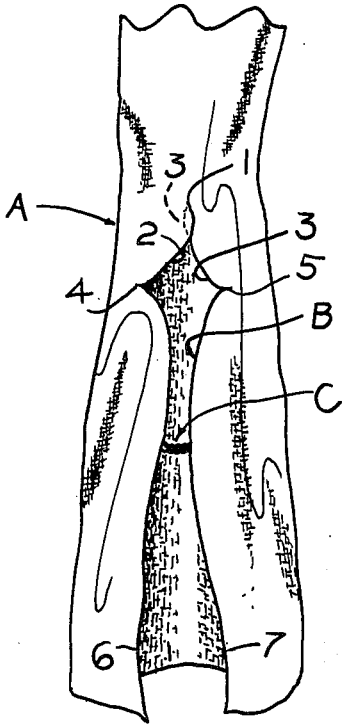
FIG. 2.
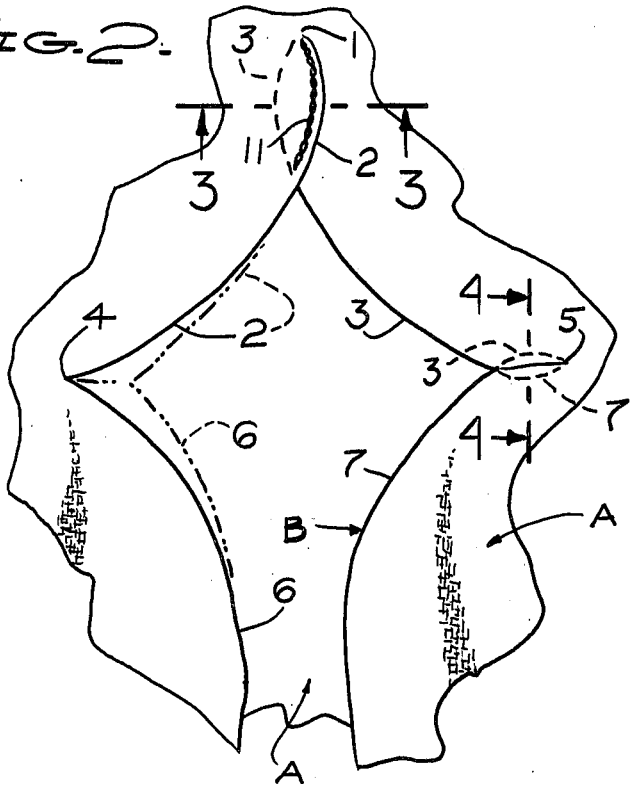
FIG. 3.
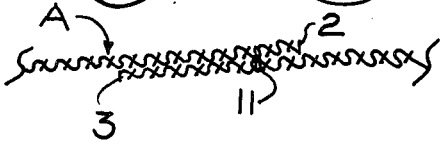
FIG. 4.
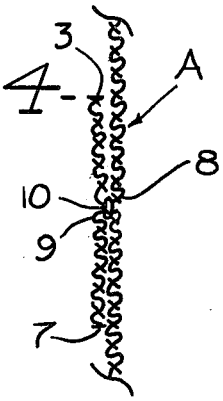
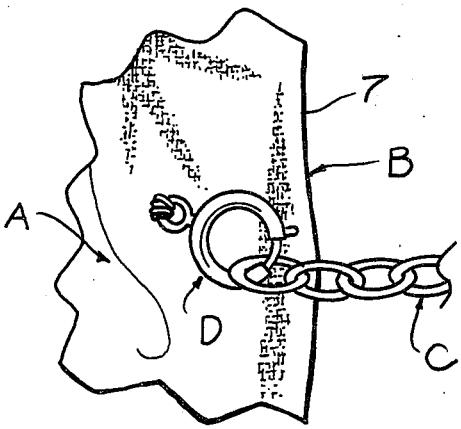
FIG. 5.
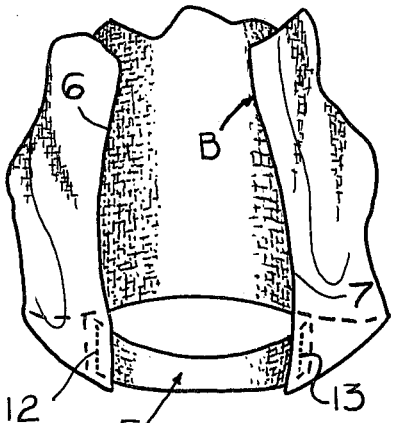
FIG. 6.

FULL LENGTH SPLIT BELL TROUSERS

SUMMARY OF THE INVENTION

An object of my invention is to provide a full length split bell pair of trousers in which each leg has a cut-out front portion extending from substantially the knee area to the bottom of the leg. The two side edges of each cut-out portion are supported in a novel manner that will cause these edges to fall in practically straight lines and thus each leg will retain its substantially tubular shape throughout its length.

A further object of my invention is to provide a pair of trousers of the type described and in which distance limiting means extends between the two side edges of each cut-out portion for preventing the adjacent side edges from separating unduly while the garment is being worn and the user is walking.

Other objects and advantages will be set forth in the detailed description of the device.

BRIEF DESCRIPTION OF THE DRAWING

FIG. 1 is a front elevation of one leg of the trousers illustrating my invention. The distance limiting chain is shown positioned slightly above the midportion of the removed area and interconnecting the adjacent side edges.

FIG. 2 is an enlarged front elevation of a portion of the trouser leg shown in FIG. 1, and illustrates the upper part of the cut-out portion. The left hand side of the cut-out portion shows in full lines the actual cut and illustrates in double dot-dash lines the finished result when a tuck or dart is taken in the material. The top center of the cut-out portion shows a tuck while the right hand side illustrates a dart being taken in the material.

FIG. 3 is an enlarged section of the tuck and is taken along the line 3—3 of FIG. 2 and shows the stitching interconnecting the two folded portions.

FIG. 4 is an enlarged section of the dart and is taken along the line 4—4 of FIG. 2 and illustrates the stitching interconnecting the two portions.

FIG. 5 is an enlarged interior view of a portion of the bottom of the trouser leg and illustrates how an end of the distance limiting chain is removably secured in place.

FIG. 6 is an enlarged exterior view of the bottom of the trouser leg and illustrates another type of flexible distance limiting means that interconnects the adjacent edges together of the cut-out portion.

DESCRIPTION OF THE PREFERRED EMBODIMENTS

In carrying out my invention I illustrate one leg A of a pair of trousers that has an opening in the tubular shape, indicated generally at B, which extends substantially from the knee area to the trouser bottom. Both legs of the trousers are identical to each other and the showing and description of one leg will suffice for both. The top 1 of the cut-out portion has two downwardly and outwardly inclined edges 2 and 3, extending therefrom and may be straight or slightly curved as shown in FIG. 2. These two edges 2 and 3, terminate at two spaced apart points 4 and 5, respectively, and then the remainder of the cut-out portion to the bottom of the leg consists of two edges 6 and 7, which extend downwardly from the points 4 and 5, respectively. These edges 6 and 7 may be straight or have a slight curve in them.

The leg A may be made of any desired flexible material and it is preferably bell bottom in shape, see FIG. 1. I provide novel means for holding the cut-out portion in the shape shown in this FIG. 1, even during the movement of the leg portion when worn by a person who is walking. If this means of supporting the edges of the cut-out portion B, were not used, the edges 6 and 7 would have a tendency to swing rearwardly with respect to the person's leg and expose too much of it. Also, the purpose of the tubular leg of the trousers is to protect the wearer's leg and if the lower part of the trouser leg swings rearwardly during the walking procedure, the garment ceases to be a protection to the wearer's leg. The purpose of the supporting means for the trouser leg is to maintain its semi-circular or tubular shape at all times while the garment is being worn.

In FIG. 2, I show the left hand side edges 2 and 6 of the cut-out portion B, before anything is done to cause the edge 6 to maintain a substantially vertical line when the garment is being worn and the person is walking. What I do to the left hand side of the cut-out portion, I show in the right hand portion with the edges 3 and 7 in FIGS. 2 and 4. The edge 3 is folded back on itself as is clearly shown in FIG. 4, the fold being indicated at 8, and likewise the edge 7 is folded back on itself at 9 for a certain distance from the right hand point 5, indicated in FIG. 2. Stitching 10, see FIG. 4, shown in cross section, secures the two folds 8 and 9 in the material together and this will lift the entire length of the substantially vertical portion of the edge 7. A dart has been formed in the material shown in both FIGS. 2 and 4. What I have described in detail for the right hand edges 3 and 7 of the cut-out portion, I do to the left hand edges 2 and 6 with the result that these latter edges will be moved to their double dot-dash line positions, as shown, when in the finished garment.

In addition, I provide a tuck in the material where the two edges 2 and 3 meet at the top center point 1, see FIGS. 2 and 3. The portions of these edges 2 and 3 disposed adjacent to the top point 1 are lapped as shown in cross section in FIG. 3 and stitching 11 secures the two lapped portions together. The tuck in the material adjacent to the top point 1 and the two darts adjacent to the side points 4 and 5, tend to draw the edges 2 and 3 of the cut-out portion closer together. At the same time the two darts adjacent to the side points 4 and 5 will physically lift the substantially vertical portions of the edges 6 and 7 and tend to move them closer together. The tendency of these two edges 6 and 7 will be to move toward each other when the trousers are worn and this tendency will overcome the other tendency for the cloth in the leg from the knee portion and on down to the bottom of the leg, to swing rearwardly caused by the walking of the person wearing the garment. In other words the two leg portions of the trousers will tend to retain their generally tubular configuration when viewed in cross section even though the front portion of the leg has the cut-out portion. This is vital to the garment retaining its normal shape while still exposing what is worn on the leg.

As a further explanation of how the trouser leg portion will retain its normal shape during walking while still exposing what is worn on the leg, let us assume that the inclined edge 2 of the cut-out portion 2 is a different piece of material from the inclined edge 6 when viewed adjacent to the left hand point 4 on the garment, see FIGS. 1 and 2. When these two edges 2 and 6 are joined together by the side dart 4 for a portion of their lengths, the resultant effect is a leverage on the edge 6 creating an upward pulling force on this edge that will cause a forward swing of the bottom of the trouser bell. This forward swing on the edge 6 is also created on the edge 7 by the dart 5 and this forwarding swing of the trouser bell will offset any tendency for the trouser bell to swing rearwardly during the walking process of the person wearing the garment.

In FIGS. 5 and 6, I illustrate two different distance limiting means for preventing the cut-out edges 6 and 7 from spreading too far apart. In FIG. 5, an inner side of the leg portion with its edge 7, is illustrated. One end of a line ornamental chain C, is shown, and it is removably secured in place by a standard ring-shaped catch D. The other edge 6 of the leg portion is not shown in FIG. 5, but it would be the same as already described for the edge 7. When the chain C, is used, it will limit the distance the two edges 6 and 7 can move away from each other.

The chain can be placed at any position desired along the cut-out portion in the trouser leg. For example, FIG. 1, shows the chain C, positioned slightly above the middle of the full length of the cut-out portion. The chain can function as an ornament as well as physically limiting the spread between the two adjacent edges 6 and 7 of the cut-out portion in the leg.

FIG. 6 illustrates a strip of cloth E, extending between the two side edges 6 and 7 of the cut-out portion in the leg. The two ends of the flexible strip E, are stitched at 12 and 13 to the garment leg.

The tuck and darts at points 1, 4 and 5 provide a simple means for maintaining the shape of the cut-out leg portions when the garment is worn and the wearer is walking. The two main features are: (one) to expose the foot or leg wear of the person wearing the garment; and (two) to provide a greater comfort to the wearer by reducing the binding and the effective weight of the garment in the knee area and by permitting the leg to be cooled through the opening.

There is less cloth in the trouser legs and the cut-out portions will give greater comfort in the flexing of the person's knees because there is a less binding action at the knees. This permits freer movement with less weight of cloth and a less weight pulling downwardly at the knee area. It is easier for a person to get into the trousers when dressing, especially if the person has arthritis or is weak.

The garment can be more readily and economically packed.

I claim:

1. A trouser leg having:

(a). a substantial slit in the front portion extending from the knee area to the leg bottom;

(b). means for lifting the side edges of the slit for preventing these edges from swinging rearwardly during the walking process of the wearer of the garment; and (c). said lifting means for the side edges including a dart in each side edge for shortening the effective length of each edge thereby causing both of the side edges to hang in close proximity to each other with a tendency to swing forwardly and thereby overcome the tendency for the side edges to swing rearwardly during the walking process and expose the sides of the leg.

2. A trouser leg having:

(a). a substantial slit in the front portion extending from the knee area to the leg bottom;

(b). means for supporting the side edges of the slit for preventing these edges from swinging rearwardly during the walking process of the wearer of the garment;

(c). said means including a distance limiting means interconnecting the two side edges of the slit for preventing the spread of said edges beyond said limiting means;

(d). said side edges are shortened in length by providing an overlap of material in each edge; and (e). whereby the two side edges will be moved toward each other.

* * * * *